US009119469B2

(12) United States Patent
Seefeldt et al.

(10) Patent No.: US 9,119,469 B2
(45) Date of Patent: Sep. 1, 2015

(54) PLATFORM ASSEMBLY FOR SUPPORTING CABINETS

(75) Inventors: David A. Seefeldt, Mishicot, WI (US); Joshua D. Nigbor, Two Rivers, WI (US); David A. Ansorge, Newton, WI (US)

(73) Assignee: Laboratory Solutions International, LLC, Manitowoc, WI (US)

( * ) Notice: Subject to any disclaimer, the term of this patent is extended or adjusted under 35 U.S.C. 154(b) by 0 days.

(21) Appl. No.: 13/551,103

(22) Filed: Jul. 17, 2012
(Under 37 CFR 1.47)

(65) Prior Publication Data

US 2013/0264927 A1 Oct. 10, 2013

Related U.S. Application Data

(60) Provisional application No. 61/621,748, filed on Apr. 9, 2012.

(51) Int. Cl.
*A47B 91/00* (2006.01)

(52) U.S. Cl.
CPC ..... *A47B 91/005* (2013.01); *Y10T 29/49959* (2015.01)

(58) Field of Classification Search
USPC ..... 312/351.1, 107, 108, 140.1, 198, 243, 312/257.1, 265.1, 278; 248/345.1, 500, 680
See application file for complete search history.

(56) References Cited

U.S. PATENT DOCUMENTS

| | | | | |
|---|---|---|---|---|
| 2,480,568 | A | | 8/1949 | Garvin |
| 2,620,252 | A | | 12/1952 | Restivo |
| 2,732,273 | A | | 1/1956 | Schaffner |
| 3,371,977 | A | | 3/1968 | McCabe |
| 3,410,622 | A | | 11/1968 | Stewart |
| 3,819,245 | A | | 6/1974 | Tacke et al. |
| 4,421,365 | A | * | 12/1983 | Taniwaki ..... 312/198 |
| 4,489,996 | A | | 12/1984 | Norton et al. |
| 4,973,110 | A | | 11/1990 | Nyquist |
| 5,655,821 | A | | 8/1997 | Laboch et al. |
| 5,967,634 | A | * | 10/1999 | Baca ..... 312/242 |
| 6,044,610 | A | * | 4/2000 | DeVon et al. ..... 52/653.1 |
| 6,345,874 | B2 | * | 2/2002 | Duong et al. ..... 312/351.1 |
| 6,470,644 | B2 | * | 10/2002 | James et al. ..... 52/745.06 |
| 6,840,591 | B2 | | 1/2005 | Wessel |
| 8,579,388 | B2 | * | 11/2013 | Centazzo et al. ..... 312/108 |
| 2008/0303386 | A1 | * | 12/2008 | Ackerman et al. ..... 312/140.1 |
| 2013/0181591 | A1 | * | 7/2013 | Bergevin ..... 312/351.1 |

OTHER PUBLICATIONS

Grainger Industrial Supply, Z Brackets Product Information Sheet, retrieved from http://www.grainger.com/Grainger/wwg/search.shtml?gclid=CJzpz-SyobECFeEDQAodviyraQ&searchQuery=z+Brackets&op=search&Ntt=z+brackets&N=0&sst=subset&cm_mmc=PPC:%20Google%20Main%201-_-Security%20-Locking%20Systems-_-Z%20Brackets-_-%20+z%20+brackets&ef_id=gWJQBbaKxC8AAEAq:20120717190130:s, on Jul. 17, 2012 (1 page).

* cited by examiner

*Primary Examiner* — Daniel Rohrhoff
(74) *Attorney, Agent, or Firm* — Boyle Fredrickson, S.C.

(57) ABSTRACT

A platform assembly for supporting one or more cabinets includes a first rail having a generally z-shape in cross-section, a second rail having a generally c-shape in cross-section and extending generally parallel to the first rail, and a plurality of connector rails coupled to and extending generally transverse to the first and second rails. End rails are also coupled to respective terminal ends of the first and second rails. The first and second rails are made of metal so that at least the first rail provides a metal toe-kick below the one or more cabinets.

16 Claims, 5 Drawing Sheets

PLATFORM ASSEMBLY FOR SUPPORTING CABINETS

The present application claims the filing benefit of U.S. Provisional Application Ser. No. 61/621,748, filed Apr. 9, 2012, the disclosure of which is hereby incorporated herein by reference in its entirety.

FIELD OF THE INVENTION

The present invention relates generally to cabinetry and, more particularly, to platform assemblies upon which cabinets are supported and leveled, as well as related methods.

BACKGROUND OF THE INVENTION

Typically, cabinets installed on a floor surface include a supporting platform or base, which may be separate or integral with the cabinets. The platform or base is provided to level and support the cabinets at an appropriate height, including any work surface supported thereon.

For example, a wooden platform made of several interconnected lengths of wood can be installed and leveled on a floor surface, and cabinets can thereafter be installed on the wooden platform. Typically, the cabinets are fastened to the wooden platform with screws or fasteners located on the bottom front and rear portions of the cabinets. Such attachments can be difficult, especially at the back side of the cabinets, which is often positioned adjacent a wall. In some cases, a cabinet can itself include an integral base portion that serves a similar function as a separate platform.

When a separate platform is used, the cabinets must be properly positioned and aligned on the platform. This is typically accomplished by measuring and registrating the cabinets relative to the supporting platform which is oftentimes prone to error and complicates the installation process for the cabinet installer. Moreover, in separate wood platforms, the lengths of wood making up the wooden platform are susceptible to changes caused by environmental conditions, such as temperature and humidity, and these changes are not necessarily predictable or desirable.

Further, the cabinets typically include an undercut toe-kick region to allow people to stand nearby the cabinets. The toe-kicks often include a panel for protecting the cabinets and/or platform from being kicked and damaged by people's footwear. These panels are added to the cabinets after the installation of either or both of a platform and cabinets, and are separate components from either the platform or the cabinets. Thus, in addition to materials for cabinets and platforms, a cabinet installer must also maintain and provide panels for the toe-kick region which adds to the various materials required for proper installation of the cabinets.

Therefore, there exists a need for cabinet mounting structure that can improve and simplify the installation and leveling of cabinets on a supporting platform.

SUMMARY OF THE INVENTION

The present invention overcomes the foregoing and other shortcomings and drawbacks of heretofore known cabinets and platform assemblies for supporting cabinets thereon. While the invention will be described in connection with certain embodiments, it will be understood that the invention is not limited to these embodiments. On the contrary, the invention includes all alternatives, modifications and equivalents as may be included within the spirit and scope of the present invention.

According to one aspect of the present invention, a platform assembly, which may be made of metal, such as galvanized steel for example, is provided for supporting one or more wood cabinets above a floor surface. In one embodiment, the platform assembly includes a first rail having a generally z-shape in cross-section, a second rail having a generally c-shape in cross-section and extending generally parallel to the first rail, and a plurality of connector rails coupled to and extending generally transverse to the first and second rails. At least the first rail provides a metal toe-kick below the wood cabinets supported on the platform assembly.

In another aspect of the present invention, a kit for mounting one or more cabinets on a platform is provided. The kit includes a platform assembly including a first rail, a second rail configured to extend generally parallel to the first rail, and a plurality of connector rails configured for coupling to and extending generally transverse to the first and second rails. The kit also includes a plurality of clips, such as z-shaped clips, that are configured for attachment to the one or more cabinets. In particular, the plurality of clips are configured to engage the second rail so as to register the one or more cabinets relative to the platform assembly.

In yet another aspect of the present invention, a method of installing one or more cabinets on a platform assembly having a first rail and a second rail is provided. The method includes attaching a plurality of clips, such as z-shaped clips, to the one or more cabinets, mounting the one or more cabinets on the platform assembly, and engaging the plurality of clips with the second rail so as to register the one or more cabinets relative to the platform assembly.

According to another aspect of the present invention, a platform assembly for supporting one or more cabinets is provided and includes a first rail, a second rail extending generally parallel to the first rail, a plurality of connector rail members coupled to and extending generally transverse to the first and second rails, and a pair of end rails coupled to respective terminal ends of the first and second rails. Each of the connector rail members and the end rails are identical in shape. Two connector rail members can be positioned adjacent each other to form a connector rail pair.

In yet another aspect of the present invention, a method of installing one or more cabinets on a platform assembly having a first rail and a second rail is provided. The method includes clipping the one or more cabinets with the second rail so as to register the one or more cabinets relative to the platform assembly, and fastening the one or more cabinets with the first rail.

The present invention provides several advantages. For example, a platform assembly made of metal provides a more stable and durable platform than a comparable platform assembly made of wood. In addition, by using metal, the amount of wood product consumed and used in a cabinet installation is reduced. A metal toe-kick is also advantageously durable, and is integral with the platform assembly. In addition, the clips and the upper lip of the rear rail engage each other and aid in the efficient placement, leveling, and installation of cabinets on the platform assembly, and the upper lip of the front rail allows for easy attachment of a cabinet to the platform assembly. Furthermore, the platform assembly is compatible with several types of floors, including concrete floors, laminate floors, carpeted floors, wooden floors, and others. And since the end rails and connector rail members may be identical in shape, the number of differently-shaped products used in the platform assembly is minimized. And because the platform assembly can be installed and leveled without the cabinets, these steps can be done while cabinets are being manufactured or in transit to the construction site. The platform assembly can also be made to any desired dimension, either by manufacturing components thereof to the desired dimensions or by making on-site modifications of components to give them the desired dimensions. Furthermore, components of the platform assembly can be sold in bulk, in kit form, or individually, thereby providing several options for purchasers. In addition, a method of installing cabinets that does not require measurements of the relative positions of the cabinet and platform advantageously improves and simplifies the ease and efficiency of installation.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with the general description of the invention given above, and the detailed description given below, serve to explain the principles of the invention.

DETAILED DESCRIPTION OF THE PREFERRED EMBODIMENTS

Figure 1:
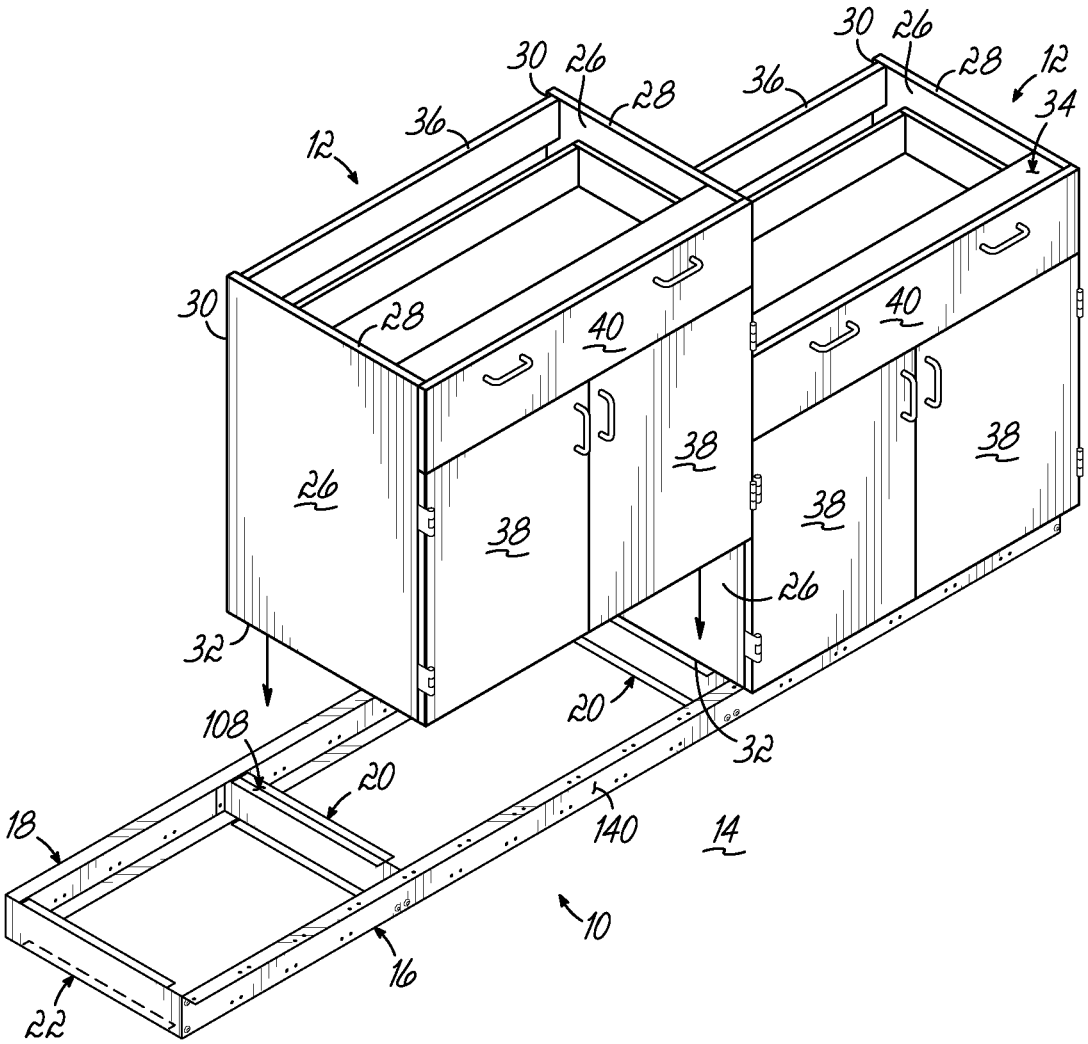
FIG. 1 is a perspective view showing a platform assembly constructed according to one embodiment of the present invention having one cabinet installed on the platform assembly and another cabinet positioned for installation on the platform assembly.

Referring now to the figures, FIG. 1 illustrates a platform assembly 10 according to one embodiment for supporting one or more cabinets 12 above a floor surface 14. As will be described in greater detail below, the platform assembly 10 may be made of metal, such as steel, for supporting cabinets 12 which may be made of any suitable material. The platform assembly 10 generally includes a front rail 16, a rear rail 18, connector rails 20, and a pair of end rails 22, 24 (end rail 24 being visible in FIGS. 2-4).

In the embodiment shown, each cabinet 12 includes opposed side panels 26, with each side panel 26 having an upper edge 28, a rear edge 30, and a lower edge 32. The upper edges 28 of the cabinets 12 define a worktop support surface 34 for supporting a work surface (not shown) to be installed on the cabinets 12. The lower edges 32 are configured for at least partially supporting the cabinets 12 on the platform assembly 10. A fastening rail 36 extends between opposed side panels 26 of each cabinet 12 for securing the cabinet to a wall (not shown), such as by securing the fastening rail 36 to support studs in a wall. In one embodiment, each cabinet 12 also includes hinged door panels 38 and one or more drawers 40. Various features of the cabinet 12, such as the side panels 26, door panels 38 and drawers 40 can be made of wood, a wood composite material, a wood laminate, a simulated wood material, or other suitable cabinet material, such as bamboo, plastics, metals, and the like. The general features of cabinets 12 are typical of cabinet construction, and other configurations of cabinets are also contemplated for use with the platform assembly 10. It will be appreciated that in certain contexts, a cabinet might not be positioned adjacent a wall. It might instead be positioned away from a wall, such as in the form of an island cabinet. While directional terms are used herein (such as "front" rail and "rear" rail), those terms are not limiting and are used simply to aid in the description of the embodiments disclosed herein. While more general terms could also be used, such as "first" rail, "second" rail, etc., the directional terms used herein should assist the reader in understanding what is described.

Figure 2:
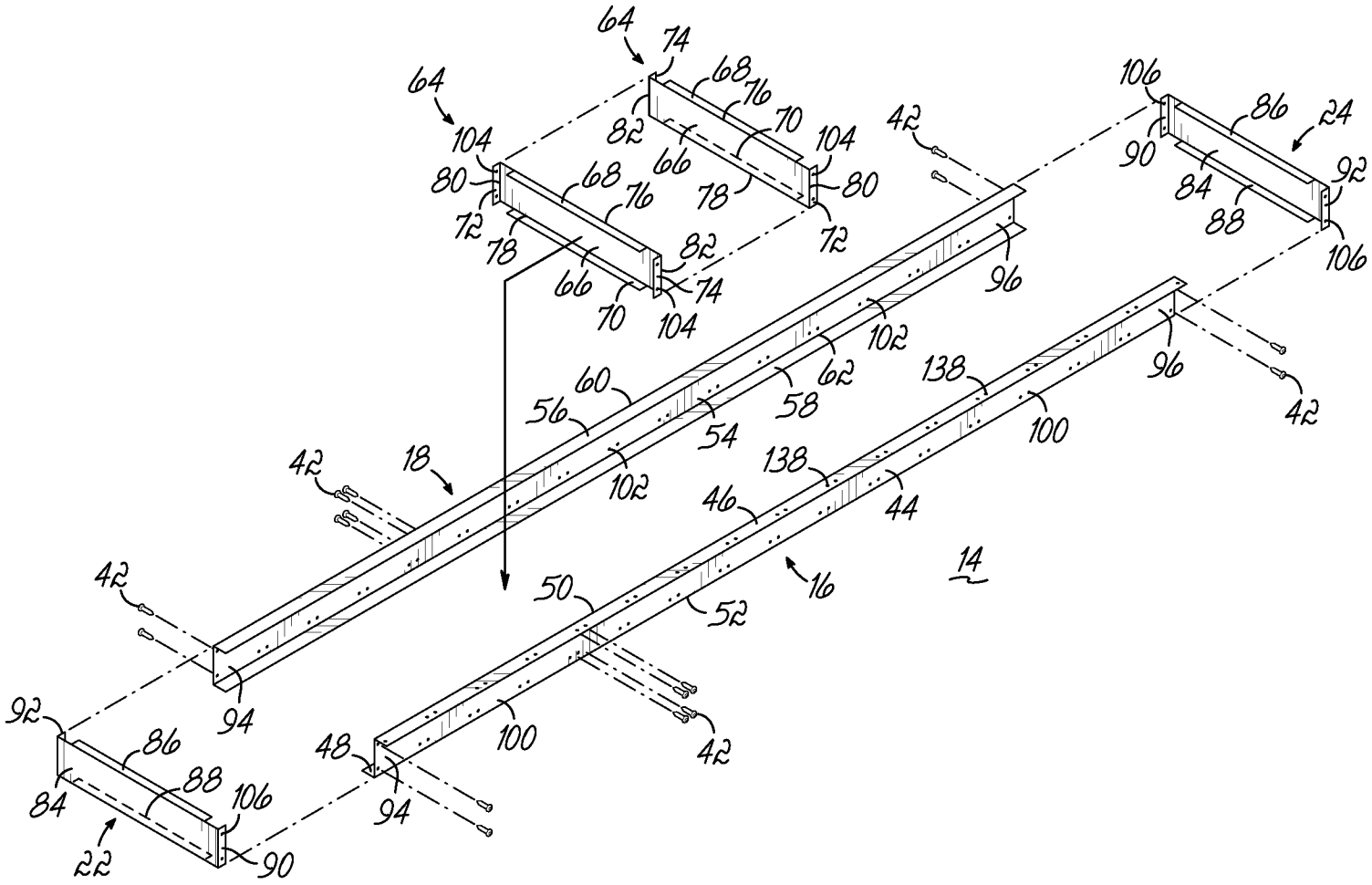
FIG. 2 is a disassembled perspective view of the platform assembly of FIG. 1 showing the platform assembly including a front rail, a rear rail, connector rails, and a pair of end rails.
Figure 3:
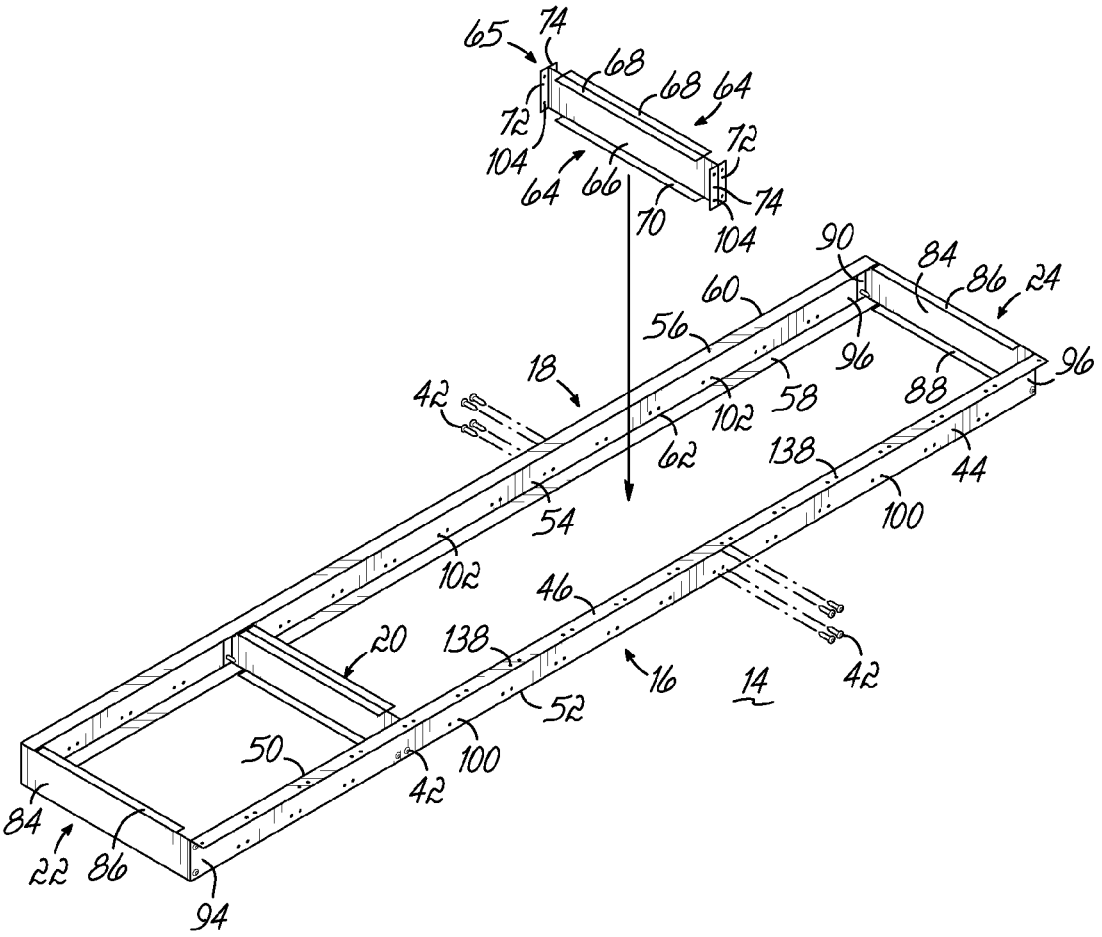
FIG. 3 is a view similar to FIG. 2 showing mounting of the connector rails between terminal ends of the front and rear rails.
Figure 4:
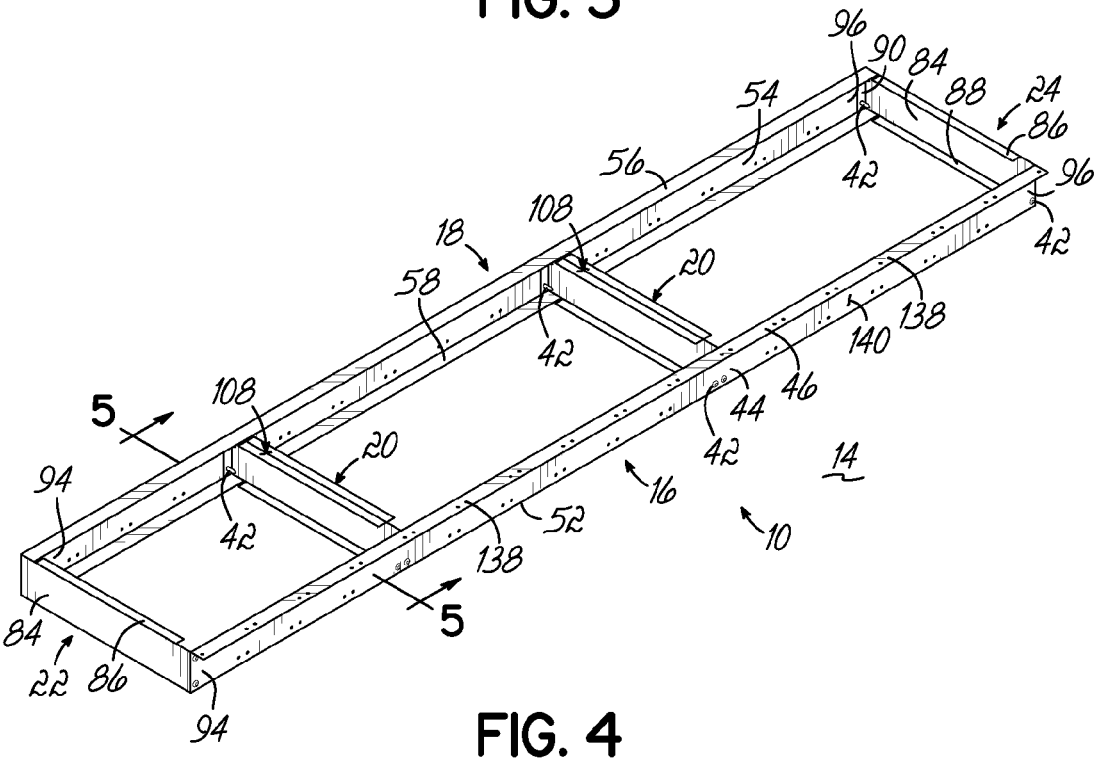
FIG. 4 is an assembled perspective view of the platform assembly shown in FIGS. 1-3.

With reference to FIGS. 2-4, the front rail 16 and rear rail 18 extend generally parallel to each other, and the connector rails 20 are connected to and extend generally transverse to the front and rear rails 16, 18. The end rails 22, 24 are also connected to and extend generally transverse to the front and rear rails 16, 18. The connector rails 20 and the end rails 22, 24 all extend generally parallel with each other. The connector rails 20 and end rails 22, 24 are attached to the front and rear rails 16, 18 by a plurality of fasteners 42. Fasteners 42 can include screws (which are shown), bolt and nut combinations, or any other suitable mechanical fastener.

In one embodiment of the present invention, the front rail 16 has a generally z-shape in cross-section (also shown in FIGS. 5 and 6) and includes an intermediate portion 44, an upper lip 46, and a lower lip 48. The upper lip 46 extends from an upper region 50 of the intermediate portion 44, and the lower lip 48 extends from a lower region 52 of the intermediate portion 44. The upper lip 46 and lower lip 48 extend generally parallel with each other, but in different directions from the intermediate portion 44. The upper lip 46 and lower lip 48 extend generally transverse to the intermediate portion 44. Thus, the configuration of the upper lip 46, the intermediate portion 44, and the lower lip 48 give the front rail 16 its generally z-shape. In the assembled configuration of the platform assembly 10, the upper lip 46 extends away from the rear rail 18, while the lower lip 48 extends toward the rear rail 18. As will become evident from the following description, in addition to providing support for the cabinets 12 positioned thereon, the front rail 16 provides a durable toe-kick as well.

The rear rail 18 may have a generally c-shape in cross-section (also visible in FIGS. 5 and 6) and includes an intermediate portion 54, an upper lip 56, and a lower lip 58. The upper lip 56 extends from an upper region 60 of the intermediate portion 54, and the lower lip 58 extends from a lower region 62 of the intermediate portion 54. The upper lip 56 and the lower lip 58 extend generally parallel with each other and in the same direction from the intermediate portion 54. The upper lip 56 and lower lip 58 extend generally transverse to the intermediate portion 54. Thus, the configuration of the upper lip 56, the intermediate portion 54, and the lower lip 58 give the rear rail 18 its generally c-shape. In the assembled configuration of the platform assembly 10, both the upper lip 56 and the lower lip 58 extend toward the front rail 16.

The front and rear rails 16, 18 extend along a length, and, as shown, the intermediate portion 44 of the front rail 16 is generally coextensive along that length with the upper lip 46 and the lower lip 48. Likewise, along the length of the rear rail 18, the intermediate portion 54 is generally coextensive with the upper lip 56 and the lower lip 58. Other configurations are also contemplated, such as where the upper lips 46, 56 and/or lower lips 48, 58 include one or more lip segments (not shown) that are not generally coextensive with the intermediate portions 44, 54. In these or other configurations, the lip segments may be spaced apart.

With continued reference to FIGS. 2-4, and according to one embodiment, each connector rail 20 includes a pair of connector rail members 64 that form a connector rail pair 65, with each connector rail member 64 of the connector rail pair 65 being identical in shape. Each connector rail member 64 includes an intermediate portion 66, an upper lip 68, a lower lip 70, a first side lip 72, and a second side lip 74. The upper lip 68 extends from an upper region 76 of the intermediate portion 66 and the lower lip 70 extends from a lower region 78 of the intermediate portion 66. The upper and lower lips 68, 70 extend generally parallel with each other on opposed sides of the intermediate portion 66. In addition, the upper lip 68 and lower lip 70 both extend generally transverse to the intermediate portion 66.

The first side lip 72 of a connector rail member 64 extends from a first side region 80, and the second side lip 74 extends from a second side region 82. The first and second side lips 72, 74 extend generally parallel with each other on opposed sides of the intermediate portion 66. The first and second side lips 72, 74 both extend generally transverse to the intermediate portion 66. In addition, the first and second side lips 72, 74 extend in the same general direction from the intermediate portion 66 as the upper and lower lips 68, 70.

The connector rails 20 are configured to be mounted between the front rail 16 and rear rail 18. Particularly, the upper and lower lips 68, 70 of the connector rail members 64 of each connector rail 20 are configured to be received between the upper lips 46, 56 and the lower lips 48, 58, respectively, of the front and rear rails 16, 18. Accordingly, the upper and lower lips 68, 70 of the connector rail members 64 may not be coextensive with the intermediate portion 66 along a length of the connector rail members 64 in order to accommodate the upper lips 46, 56 and lower lips 48, 58 of the front and rear rails 16, 18. Also, the first and second side lips 72, 74 of the connector rail members 64 are configured to be received between the upper and lower lips 56, 58 of the rear rail 18, and above the lower lip 48 of the front rail 16.

As shown, a pair of connector rail members 64 is positioned adjacent each other to form a connector rail pair 65 that serves as a connector rail 20. Each connector rail member 64 is generally symmetric about its two major axes, so the upper lip 68 has the same configuration as the lower lip 70 and the first side lip 72 has the same configuration as the second side lip 74. Accordingly, a connector rail member 64 can be flipped or rotated, and what is an upper lip 68 in one configuration can become a lower lip 70 in another configuration. Likewise, what is a first side lip 72 in one configuration can become a second side lip 74 in another configuration. Referring especially to FIG. 3, in the connector rail pair 65, the intermediate portions 66 of each connector rail member 64 are directly adjacent each other and the upper lips 68 of each extend from the intermediate portions 66 away from each other. A first side lip 72 of one connector rail member 64 and a second side lip 74 of the other connector rail member 64 of a connector rail pair 65 are generally adjacent to, and extend generally away from, each other.

In one embodiment, the end rails 22, 24 are identical in shape to each other, and identical in shape to the connector rail members 64. In particular, each of the end rails 22, 24 includes an intermediate portion 84, an upper lip 86, a lower lip 88, a first side lip 90, and a second side lip 92. The intermediate portion 84 is identical in shape with the intermediate portion 66 of each connector rail member 64. Similarly, the upper lips 68, 86, lower lips 70, 88, first side lips 72, 90, and second side lips 74, 92 are all identical in shape. The end rails 22, 24 are also symmetric about their two major axes, so what is an upper lip 86 in one configuration can become a lower lip 88 in another configuration, and what is a first side lip 90 in one configuration can become a second side lip 92 in another configuration.

The end rails 22, 24 are configured to be connected to the front and rear rails 16, 18 at terminal ends thereof. In particular, the end rail 22 is connected to the front and rear rails 16, 18 at a first terminal end 94 thereof. The end rail 24 is connected to the front and rear rails 16, 18 at a second terminal end 96 thereof. The connector rails 20 are connected to the front and rear rails 16, 18 at positions between the terminal ends 94, 96.

In particular, the end rails 22, 24 and the connector rails 20 (including each connector rail member 64) are fastened to the front and rear rails by a plurality of fasteners 42. To that end, holes 100 are provided in the intermediate portions 44 of the front rail 16, and holes 102 are provided in the intermediate portion 54 of the rear rail 18. In addition, holes 104 are provided in the first and second side lips 72, 74 of each connector rail member 64, and holes 106 are provided in the first and second side lips 90, 92 of the end rails 22, 24. The holes 100, 102, 104, and 106 may be threaded, if desired. In addition to using fasteners 42 to connect the rails 16, 18, 20, 22, and 24, other forms of attachment are also contemplated.

As shown in FIG. 4, several connector rails 20 are positioned at suitable intervals between the terminal ends 94, 96. For example, one or more connector rails 20 can be provided for supporting each cabinet 12. As shown in the figures, and by way of example only, a connector rail 20 and/or an end rail 22, 24 can be positioned generally below each side panel 26 of each cabinet 12. The various holes 100, 102, 104, 106 may be provided at any suitable interval, such as to provide a three-inch on center spacing arrangement for positioning the connector rails 20. Of course, the number of connector rails 20 and the spacing therebetween might vary according to specific circumstances, and the selection thereof will be evident to a skilled artisan.

According to another embodiment, single connector rail members 64 can connect the front and rear rails 16, 18 instead of the connector rails 20 which include a pair 65 of connector rail members 64. In particular, single connector rail members 64 can be spaced along the length of the platform assembly 10 in a similar manner as the connector rails 20.

According to yet another embodiment, the connector rails 20 can include a modified connector rail member (not shown) having features similar to the connector rail pair 65, but of unitary construction. Such a modified connector rail member has a single intermediate portion (similar to the combination of intermediate portions 66 of the connector rail pair 65). First and second upper lips extend away from the intermediate portion and away from each other (similar to the two upper lips 68 of the connector rail pair 65). First and second lower lips also extend away from the intermediate portion and away from each other (similar to the two lower lips 70 of the connector rail pair 65). Finally, first, second, third, and fourth side lips extend from the intermediate portion (similar to the two side lips 72 and two side lips 74 of the connector rail pair 65).

Any or all of the front rail 16, the rear rail 18, the end rails 22, 24, and the connector rail members 64 can be made of any suitable material. In one embodiment, the rails 16, 18, 22, 24, and connector rail members 64 may be made of galvanized steel, for example, such as 16 gauge galvanized steel. Additionally, the rails 16, 18, 22, 24, and connector rail members 64 may be provided in any suitable length. For example, the front and rear rails 16, 18 may be provided in 48" and 96" lengths, and the end rails 22, 24, and the connector rail members 64 may be provided in 13.276" and 19.276" lengths. Moreover, the front and rear rails 16, 18 can be cut to any desired length, and additional holes can be easily made therein for installing the end rails 22, 24. The upper lips 46, 56, 68, and 86 of the rails 16, 18, 22, 24, and connector rail members 64 are configured to define a common cabinet support surface 108 upon which the cabinets 12 are supported. Any or all of the front rail 16, the rear rail 18, the end rails 22, 24, and the connector rail members 64 can be adjusted to provide a level cabinet support surface 108.

Figure 5:
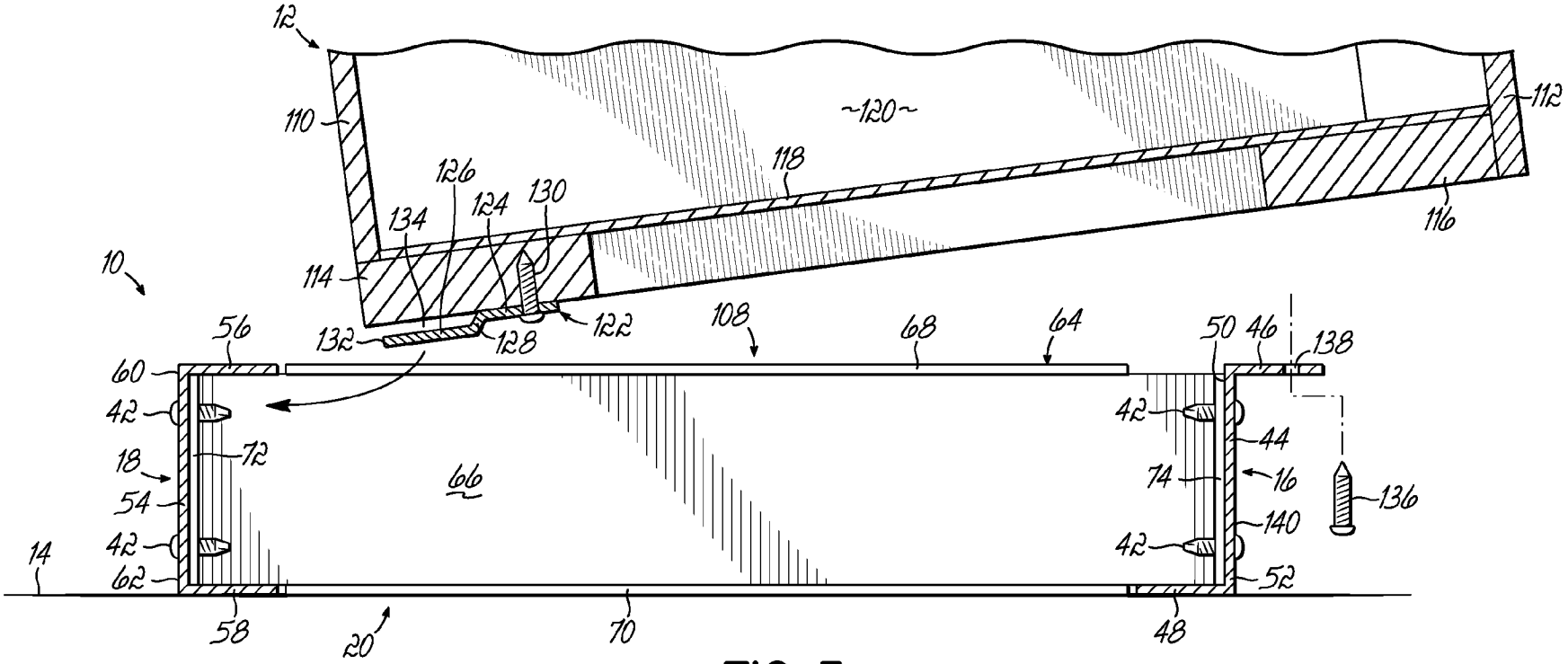
FIG. 5 is a cross-sectional view taken along line 5-5 in FIG. 4 showing a cabinet being brought into an installation position on the platform assembly.
Figure 6:
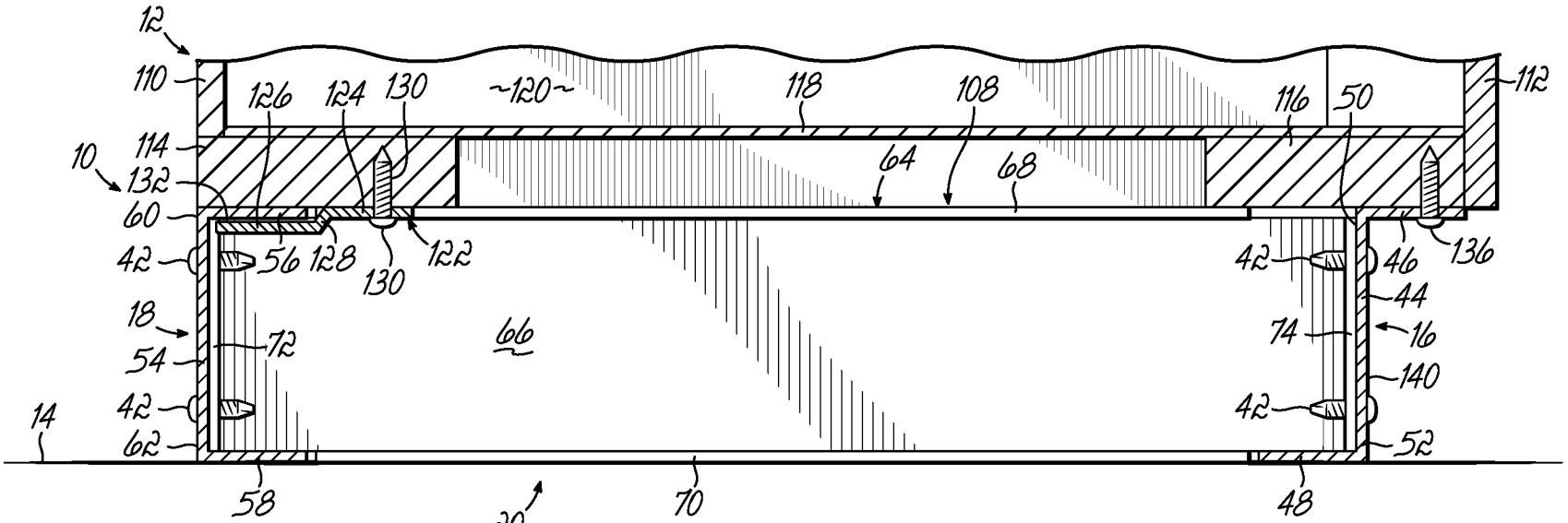
FIG. 6 is a cross-sectional view similar to FIG. 5 showing the cabinet installed on the platform assembly and with a z-shaped clip mounted on the cabinet for registering the cabinet relative to the rear rail of the platform assembly.

Referring next to FIGS. 5 and 6, and in addition to the features shown and described with respect to FIG. 1, each cabinet 12 includes a rear panel portion 110 generally opposite a face frame portion 112. The rear panel portion 110 is at the rear of the cabinet 12 and typically abuts a wall surface, whereas the face frame portion 112 is at the front of the cabinet 12 and is typically positioned just behind the door panels 38. The cabinet 12 also includes a rear frame member 114 and a front frame member 116 that are positioned generally near the bottom of the cabinet 12. A bottom panel 118 is disposed near the bottom of the interior 120 of the cabinet 12, and extends between the rear and front frame members 114, 116.

In one embodiment of the present invention, one or more clips 122, such as z-shaped clips 122 in one embodiment, are provided for attachment to each cabinet 12. The z-shaped clips 122 are for engaging the rear rail 18 so as to register each cabinet 12 relative to the platform assembly 10. In one embodiment, two z-shaped clips 122 are used per cabinet 12. Each z-shaped clip 122 includes a first plate 124 connected to a second plate 126 via a connecting portion 128. The first plate 124 extends generally parallel with the second plate 126, but is offset therefrom by a distance corresponding to the connecting portion 128. As shown, the first plate 124 is connected to the rear frame member 114 of the cabinet 12 by a fastener 130, and the second plate 126 is positioned away from the rear frame member 114 so as to constitute a free portion 132 of the z-shaped clip 122. Accordingly, a space 134 is formed between the cabinet 12 and the free portion 132 of the z-shaped clip 122. The z-shaped clip 122 is configured to engage the upper lip 56 of the rear rail 18. To that end, the dimensions and positioning of the z-shaped clip 122 may take into account the dimensions of features of the rear rail 18, including its upper lip 56. Advantageously, the upper lip 56 fits neatly into the space 134 between the cabinet 12 and the z-shaped clip 122, as shown, so that the rear portions of the cabinets 12 are clipped to the rear rail 18 of the platform assembly 10.

Once a cabinet 12 is thus positioned with respect to the rear rail 18, it can be brought into engagement with the front rail 16 and a fastener 136, such as a wood screw for example, can be used to connect the front rail 16 to the cabinet 12, such as to the front frame member 116 (FIG. 6). To that end, holes 138 are provided along the upper lip 46 of the front rail 16 for fasteners 136 to extend through. The z-shaped clips 122 can be positioned on the cabinets 12 such that installation of the cabinets 12 on the platform assembly 10 can be completed without an installer taking measurements of the cabinets 12 or the platform assembly 10. That is, the position of the z-shaped clips 122 can be chosen so the cabinets 12 are placed in a desired position relative to the platform assembly 10 so that, after the cabinets 12 have been clipped to the rear rail 18, the cabinets 12 are properly registered or aligned relative to the platform assembly 10. While a z-shaped clip 122 is shown and described, it will be appreciated that other clip configurations are possible as well without departing from the spirit and scope of the present invention. It will also be appreciated that a cabinet 12 may require leveling with respect to the platform assembly 10 once the cabinet 12 is placed thereon.

It will be appreciated that the platform assembly 10 thus provides a metal toe-kick 140 for the cabinets 12 positioned thereon. In particular, the front rail 16 provides the toe-kick 140 in a position generally adjacent the floor surface 14 and generally below the cabinet 12. In addition, the toe-kick 140 is recessed relative to the door panels 38 and the face frame portions 112. Since the front rail 16 is advantageously constructed of metal, the toe-kick 140 is durable for long-term use. While not shown, it will be appreciated that a facing of rubber or other suitable synthetic or any decorative material that has a finished appearance may be mounted on the forward face of the front rail 16 to provide an aesthetically pleasing appearance to the overall assembly.

During installation, one or more cabinets 12 may be installed onto the platform assembly 10 by engaging the clips 122 with the rear rail 18 so as to register the cabinets 12 relative to the platform assembly 10. The cabinet 12 can then be brought into engagement with the front rail 18 and attached to the platform assembly 10.

Additionally, a kit can be provided for mounting one or more cabinets 12 onto a platform assembly 10. Such a kit includes the platform assembly 10 having a front rail 16, a rear rail 18 extending generally parallel to the front rail 16, and a plurality of connector rails 20 coupled to and extending generally transverse to the front and rear rails 16, 18. The kit also includes a plurality of clips 122, such as z-shaped clips 122, that are configured for attachment to the one or more cabinets 12. The z-shaped clips 122 are configured to engage the rear rail 18 of the platform assembly 10 so as to register the one or more cabinets 12 relative to the platform assembly 10. Advantageously, the rear rail 18 of the kit includes an intermediate portion 54 and an upper lip 56 extending therefrom toward the front rail 16. The plurality of z-shaped clips 122 and the rear rail 18 are configured so that the upper lip 56 of the rear rail 18 fits between a free portion 132 of the z-shaped clips 122 and the one or more cabinets 12. Further, one or more cabinets 12 may be provided with the kit for mounting on the platform assembly 10.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicants' general inventive concept.

What is claimed is:

1. A platform assembly for supporting one or more cabinets, comprising:

a first front rail having a generally z-shape in cross-section;

a second rear rail having a generally c-shape in cross-section and extending generally parallel to the first rail;

a plurality of connector rails coupled to and extending generally transverse to the first and second rails; and a pair of end rails coupled to respective terminal ends of the first front rail and the second rear rail, wherein the first front rail includes an intermediate portion, an upper lip extending from the intermediate portion and away from the second rear rail, and a lower lip extending from the intermediate portion and toward the second rear rail, wherein the second rear rail includes an intermediate portion, an upper lip extending from the intermediate portion and toward the first front rail, and a lower lip extending from the intermediate portion and toward the first front rail, wherein each of the end rails includes an intermediate portion, an upper lip extending from the intermediate portion, a lower lip extending from the intermediate portion and opposed from the upper lip, a first side lip extending from the intermediate portion, and a second side lip extending from the intermediate portion and opposed from the first side lip, and further wherein each of the respective first side lips and second side lips of the pair of end rails is spaced from each of the respective upper lips and lower lips of the pair of end rails.

2. The platform assembly of claim 1, further comprising a pair of end rails coupled to respective terminal ends of the first front rail and the second rear rail.

3. The platform assembly of claim 2, wherein each connector rail comprises a first connector rail member and a second connector rail member forming a connector rail pair and wherein the pair of end rails are identical in shape to the first and second connector rail members.

4. The platform assembly of claim 1, wherein each connector rail comprises a first connector rail member and a second connector rail member forming a connector rail pair.

5. The platform assembly of claim 4, wherein the first and second connector rail members are identical in shape.

6. The platform assembly of claim 1, wherein the first front rail and the second rear rail are made of metal.

7. The platform assembly of claim 1, further comprising one or more cabinets for mounting on the platform assembly, wherein the one or more cabinets are made of wood, a wood composite, a wood laminate, or a simulated wood material.

8. The platform assembly of claim 7, further comprising a plurality of clips configured for attachment to the one or more cabinets, the plurality of clips being configured to engage the second rear rail so as to register the one or more cabinets relative to the platform assembly.

9. The platform assembly of claim 8, wherein the plurality of clips are z-shaped.

10. A kit for mounting one or more cabinets on a platform, comprising:

a platform assembly including:

a first rail;

a second rail configured to extend generally parallel to the first rail; and a plurality of connector rails configured for coupling to and extending generally transverse to the first and second rails; and a plurality of z-shaped clips configured for attachment to one or more cabinets for mounting on the platform assembly, the plurality of clips being configured to engage the second rail so as to register the one or more cabinets relative to the platform assembly.

11. The kit of claim 10, wherein the second rail includes an intermediate portion and an upper lip extending from the intermediate portion toward the first rail, and further wherein the plurality of z-shaped clips and the second rail are configured so that the upper lip of the second rail fits between a free portion of the z-shaped clips and the one or more cabinets.

12. The kit of claim 10, further comprising one or more cabinets for mounting on the platform assembly.

13. The kit of claim 10, wherein the second rail has a generally c-shape in cross-section and the first rail has a generally z-shape in cross-section.

14. The kit of claim 10, further comprising a pair of end rails coupled to respective terminal ends of the first and second rails.

15. A platform assembly for supporting one or more cabinets, comprising:

a first rail;

a second rail extending generally parallel to the first rail;

a plurality of connector rail members coupled to and extending generally transverse to the first and second rails; and a pair of end rails coupled to respective terminal ends of the first and second rails, wherein each of the connector rail members and the end rails are identical in shape, wherein each of the connector rail members and the pair of end rails includes an intermediate portion, an upper lip extending from the intermediate portion, a lower lip extending from the intermediate portion and opposed from the upper lip, a first side lip extending from the intermediate portion, and a second side lip extending from the intermediate portion and opposed from the first side lip, and further wherein each of the respective first side lips and second side lips of the plurality of connector rail members and the pair of end rails is spaced from each of the respective upper lips and lower lips of the plurality of connector rail members and the pair of end rails.

16. The platform assembly of claim 15, wherein two connector rail members are positioned adjacent each other to form a connector rail pair with the respective intermediate portions of the pair of connector rail members being located adjacent each other and the upper lip of one of the pair of connector rail members extending away from the upper lip of the other one of the pair of connector rail members.

* * * * *